United States Patent [19]

Carr, Jr.

[11] Patent Number: 4,830,360

[45] Date of Patent: May 16, 1989

[54] ORTHOPEDIC EXERCISE GLOVE

[76] Inventor: Earnest F. Carr, Jr., Rte. 2, Box 14, Spencer, Okla. 73084

[21] Appl. No.: 77,494

[22] Filed: Jul. 24, 1987

[51] Int. Cl.[4] ..... A63B 21/30

[52] U.S. Cl. ..... 272/67; 128/26

[58] Field of Search ..... 272/67, 68, 119, 139; 128/26; 2/159, 160, 161 A; 84/467, 468

[56] References Cited

U.S. PATENT DOCUMENTS

| | | | |
|---|---|---|---|
| 494,197 | 3/1893 | Hall | 272/67 |
| 818,332 | 4/1906 | Anson | 272/67 |
| 867,981 | 10/1907 | Krizek | 272/67 |
| 897,471 | 9/1908 | Loyola | 272/67 |
| 2,108,236 | 2/1938 | Scott | 272/67 |
| 3,347,547 | 10/1967 | Hynes | 272/67 |
| 3,445,109 | 5/1969 | Kolbel | 272/137 |
| 3,838,853 | 10/1974 | Fredenhagen | 272/67 |
| 3,944,220 | 3/1976 | Fasano | 272/67 |
| 4,220,334 | 9/1980 | Kanamoto et al. | 272/67 |
| 4,253,660 | 3/1981 | Tiktin | 272/67 |
| 4,675,914 | 6/1987 | Mitchell | 2/161 A |

FOREIGN PATENT DOCUMENTS

| | | | |
|---|---|---|---|
| 484487 | 10/1917 | France | 272/67 |
| 0931199 | 6/1982 | U.S.S.R. | 272/68 |

*Primary Examiner*—Richard J. Apley
*Assistant Examiner*—J. Welsh
*Attorney, Agent, or Firm*—Laney, Dougherty, Hessin & Beavers

[57] ABSTRACT

An orthopedic exercise glove. In a first embodiment, finger portions of the gloves have first and second connectors attached thereto, each of the connectors having a hook thereon. A tension spring is connected with the hooks and extends between the first and second connectors. Each spring is sized such that it is always in tension when connected between the two hooks, thereby tending to move the finger portions to an extended position. In a second embodiment, the connectors include flared pin portions extending therefrom, and an elastomeric tube is stretched therebetween. By varying the length of the tube, the tension therein is also varied. A method of attaching the elastomeric tube for applying force along a finger portion of the glove is disclosed, along with a method of increasing the tension by shortening the tube.

20 Claims, 2 Drawing Sheets

ORTHOPEDIC EXERCISE GLOVE

BACKGROUND OF THE INVENTION

1. Field Of The Invention

This invention relates to orthopedic exercise gloves, and more particularly, to a glove having easily detached biasing means disposed along the dorsal side of finger portions of the glove and having means for adjusting the tension in the biasing means.

2. Description Of The Prior Art

U.S. Pat. No. 3,944,220 to Fasano discloses a glove and hand exereiser wherein each finger of a glove includes a tension strap for applying tension during finger movement. The tension straps may be placed along the palm of the hand or along the back of the hand. The straps are fixed at a finger end, and an opposite end is slidably received through a holding means on the wrist, such as a ringlet or tightly pulled elastic material defining an opening therethrough. To draw the strap taut or relax the strap, it is moved through the holding means.

One problem with the Fasano device is that one end of the strap is fixed by rivets, stitching or the like, and therefore replacement of the strap by the user would be difficult in case one of the straps needs repair or if it is otherwise desired to change them. The present invention solves this problem by providing interchangeable biasing means quickly attachable at each end thereof on the exterior of the glove. Another problem with the Fasano device is that the straps are positioned on the inside of the glove and the only guiding and location of the straps during movement of the hand is by the fingers of the user and the finger stalls in which the fingers are positioned. There is noting to prevent the straps from sliding from side to side on the fingers. The present invention which includes a sleeve for receiving and guiding the biasing means insures that the biasing means is always maintained in the proper position along the finger.

A manual gymnasium for musicians using rubber cords or tubes to act as "springs" for resisting movement of the fingers of a user is shown in U.S. Pat. No. 494,197 to Hall. The springs extend between a bridge on a wrist strap to individual pads attached adjacent knuckles of each finger. At the fingers, the springs are clamped together by a strip of metal, and at the wrist bridge the ends of the strings extend through holes and are affixed thereto by such means as sewing, gluing or riveting, or by tieing a knot on the end of a strap on the opposite side of the hole. In other words, the straps are not easily adjustable, and the ends are essentially fixed and not detachable. This device does not form a glove and is an extremely cumbersome apparatus. A with the Fasano apparatus, no guiding is provided for the springs. The present apparatus which comprises a conveniently worn glove solves the problems presented with Hall.

SUMMARY OF THE INVENTION

The orthopedic exercise glove of the present invention comprises a body or hand portion for enclosing a hand of a user, a finger portion attached to the body portion for enclosing a finger of the hand, biasing means disposed along the finger portion for providing a tensile force on the finger portion, and releasable attaching means for releasably attaching the biasing means to the finger portion. Preferably, the biasing means is disposed adjacent a dorsal side of the finger portion, and the tensile force thus tends to move the finger portion to an extended position. In one embodiment, the length of the biasing means is adjustable. Guide means may be attached to the finger portion for guiding the biasing means.

The releasable attaching means is best characterized by an assembly comprising first connecting means attached to the finger portion, and second connecting means spaced from the first connecting means and attached to one of the finger and body portions, wherein the biasing means is connected to the first and second connecting means and extends therebetween.

In one embodiment, the first connecting means is characterized by a first connector comprising a hook directed toward the second connecting means, the second connecting means is characterized by a second connector comprising a hood directed toward the first connected means, and the biasing means is characterized by a tension spring having opposite ends releasably attached to the hooks. The tension spring may thus be easily interchanged with springs of different lengths or different spring rates.

In a second embodiment, the first connecting means is characterized by a first connector comprising a base portion attached to the finger portion and an elongated portion extending from the base portion and having a plurality of flared sections thereon, the second connecting means is characterized by a second connector comprising a base portion attached to one of the finger and body portions and an elongated portion extending from the base portion of the second connector and having a plurality of flared sections thereon, and the biasing means comprises a resilient tube having opposite open ends disposed over the elongated portions such that the ends are grippingly engaged with the flared sections. The tube is of an elastomeric material and has a length whereby it is always in tension when the ends thereof are grippingly engaged with the flared sections.

The guide means is best characterized by a sleeve through which at least a portion of the biasing means is disposed. The sleeve is made of flexible material and is preferably fixedly attached to the finger portion.

The first and second connecting means may be weighted, and additional weights may be positioned along the body portion as desired.

It will be seen that the second embodiment provides a method of applying a tensile force along a finger portion of an exercise glove comprising the steps of attaching a first connector with a flared pin portion thereon adjacent a distal end of the finger portion, attaching a second connector with a flared pin portion thereon to either the finger portion or hand portion, and sliding opposite ends of an elastomeric tube on each of the pin portions such that the elastomeric tube is grippingly engaged therewith and wherein the tube is of a length shorter than the distance between the first and second connectors such that the tube is stretched therebetween, thereby applying the tensile force along the finger portion. A method of changing the tensile force comprises the steps of disconnecting one of the ends of the tube from the corresponding pin portion, shortening the length of the tube by cutting off a portion thereof, thereby forming a new open end, and attaching the new open end to the corresponding pin, whereby the tensile force is increased due to the shortening of the tube.

An important object of the invention is to provide an orthopedic exercise glove having quickly releasable biasing means disposed along the finger portions of the glove.

Another object of the invention is to provide an orthopedic exercise glove having interchangeable biasing means disposed between first and second connectors along or adjacent finger portions of the glove.

A further object of the invention is to provide an orthopedic exercise glove wherein tension is applied along fingers thereof by a tension spring.

Still another object of the invention is to provide an orthopedic exercise glove having elastomeric tubing stretched along the fingers thereof for providing a tensile force on the fingers.

An additional object of the invention is to provide a method of increasing the tensile force applied by an elastomeric tube stretched along a surface of a finger of the glove.

Additional objects and advantages of the invention will become apparent as the following Detailed Description of the Preferred Embodiments is read in conjunction with the drawings which illustrate such preferred embodiments.

DETAILED DESCRIPTION OF THE PREFERRED EMBODIMENTS

Figure 1:
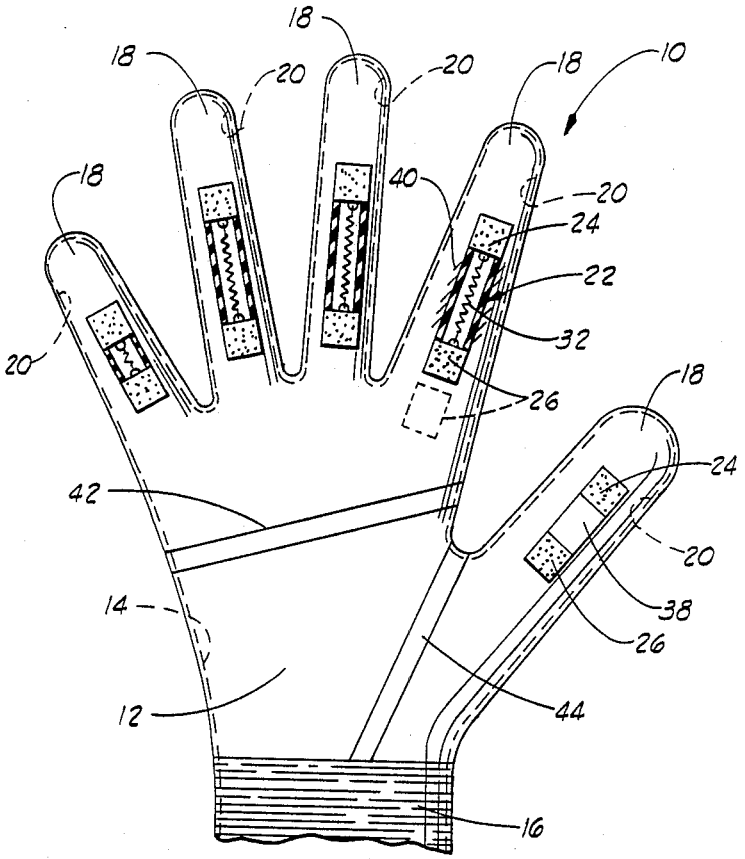
FIG. 1 shows a first embodiment of the orthopedic exercise glove of the present invention as seen from the back of the hand of the user.

Referring now to the drawings, and more particularly to FIGS. 1–4, a first embodiment of the orthopedic exercise glove of the present invention is shown and generally designated by the numeral 10. Glove 10 comprises a body or hand portion 12, defining a hand receiving cavity 14 therein with an elastic band 16 adjacent an open write end of the hand portion. Extending from hand portion 12 are a plurality of finger portions 18, each finger portion defining a finger receiving cavity 20 therein in communication with hand receiving cavity 14 and hand portion 12. Thus, it will be seen that a generally conventional glove is formed in which the hand and fingers are inserted in a normal manner. It should be noted that, for the purposes of this disclosure, the thumb of the hand of the user is considered as a finger, and no important distinction will be made between the fingers and the thumb herein.

Figure 2:
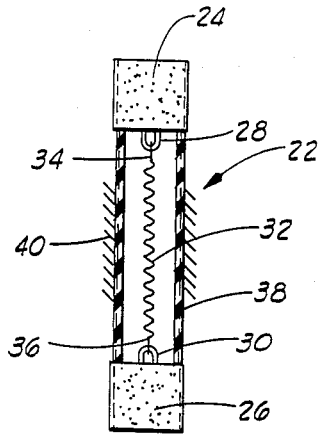
FIG. 2 is an enlarged detail of the biasing means used on the glove shown in FIG. 1.

Disposed longitudinally along each finger portion 18 is a biasing means assembly 22. Preferably, biasing means assembly 22 is on the dorsal side or back of finger portion 18, but it will be evident that the biasing means could also be on the palmal side or inside of the finger portion. Biasing means assembly 22 is shown in elevation on the thumb in FIG. 1 and in cross section on the other fingers. Biasing means assembly 22 comprises a first connector 24 positioned toward a distal end of finger portion 18 and a second connector 26 positioned adjacent hand portion 12. As shown in FIG. 1, second connector 26 is actually on finger portion 18, adjacent hand portion 12. However, it should also be understood that second connector 26 could also be connected on hand portion 12 adjacent finger portion 18, as indicated by phantom lines on the index finger in FIG. 1. First connector 24 has a hook 28 thereon directed toward second connector 26, and second connector 26 has a hook 30 thereon directed toward first connector 24. In the preferred embodiment, each hook 28 and 30 is of a generally U-shaped configuration, as best seen in FIG. 2.

Biasing means in the form of a longitudinally disposed coiled tension spring 32 extends between first and second connectors 24 and 26 and includes a first end 34 connected to hook 28 and a second end 36 connected to hook 30. Spring 32 is of a length such that it is always in tension when connected between hooks 28 and 30 even when in the extended position of finger portion 18 shown in FIG. 3. Thus, the biasing means applies a force tending to move first and second connectors 24 and 26 together, that is, tending to shorten the distance between them. Ends 34 and 36 of spring 32 are of a conventional hook-type and are adapted to be easily connected and disconnected from hooks 28 and 30. Of course, the tension in spring 32 keeps first and second ends 34 and 36 engaged with hooks 38 and 30, respectively. Springs 32 may be easily detached at both ends thereof and interchanged with springs having a different length or spring rate for varying the tension applied.

Also extending between first and second connectors 24 and 26 and surrounding spring 32 is a sleeve 38 which is made of a flexible material, such as cloth, connected to finger portion 18 by means such as sewing the sleeve thereto, as indicated by reference numeral 40. Any other conventional method of attaching sleeve 38 could also be used. Sleeve 38 acts as a guide means for guiding spring 32 such that it is not skewed to one side when finger portions 18 are bent as shown in FIG. 4.

Figure 3:
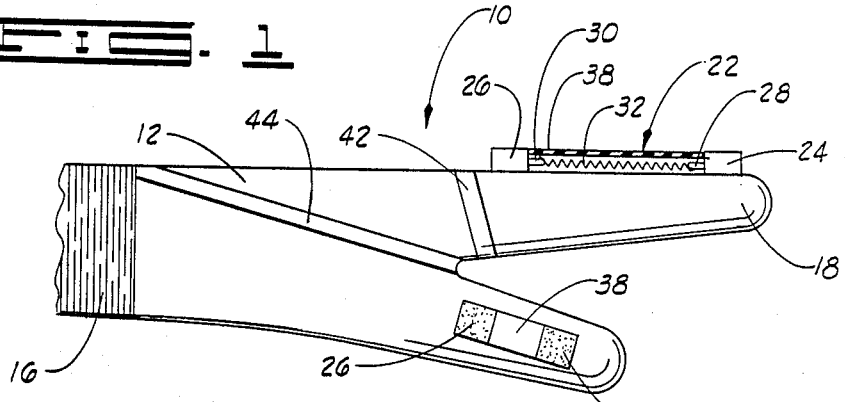
FIG. 3 is a side view of the first embodiment with the fingers extended.
Figure 4:
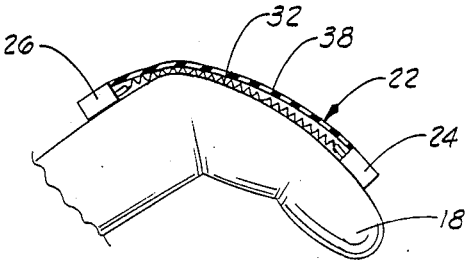
FIG. 4 is an enlarged view showing a finger portion of the first embodiment with the user's finger bent.

It will be seen that when finger portions 18 are bent as shown in FIG. 4, with biasing means assembly 22 on the dorsal side, the tension in each spring 32 is increased and provides a force tending to return the fingers to the extended position shown in FIG. 3, at which the length of spring 32 is at a minimum. In this way, by bending the fingers in glove 10 and thereby increasing the tension in each finger portion 18, the user may exercise and strengthen the fingers.

Additional means for helping strengthen the fingers and hand during exercise use of glove 10 are provided by weighted bands 42 and 44. The actual positioning of such bands may vary as desired. The important point is that by weighting glove 10, additional resistance to lifting the hand and moving the fingers is provided. In the preferred embodiment, but not by way of limitation, first and second connectors 26 are made of lead to provide additional weight on the fingers.

Referring now to FIGS. 5–8, a second embodiment of the orthopedic exercise glove of the present invention is shown and generally designated by the numeral 46. As with first embodiment 10, glove 46 includes a hand portion 12 defining a hand receiving cavity 14 therein with a plurality of finger portions 18 extending therefrom, each finger portion defining a finger receiving cavity 20 herein in communication with hand receiving cavity 14. An elastic wrist band 16 is provided on the open wrist end portion of hand portion 12. Again, no distinction is made between the thumb and fingers; each is referred to as a finger portion 18.

Second embodiment 46 includes biasing means assembly 22' preferably disposed on the dorsal side of finger portions 18, although positioning on the palmal side is also possible. Biasing means assembly 22' includes first and second connectors 48 and 50, respectively. In the preferred embodiment, first and second connectors 48 and 50 are substantially identical, and each comprises a base 52 defining a substantially annular ring and having a pin portion 54 extending therefrom in a direction substantially perpendicular to a central axis of the ring.

Figure 5:
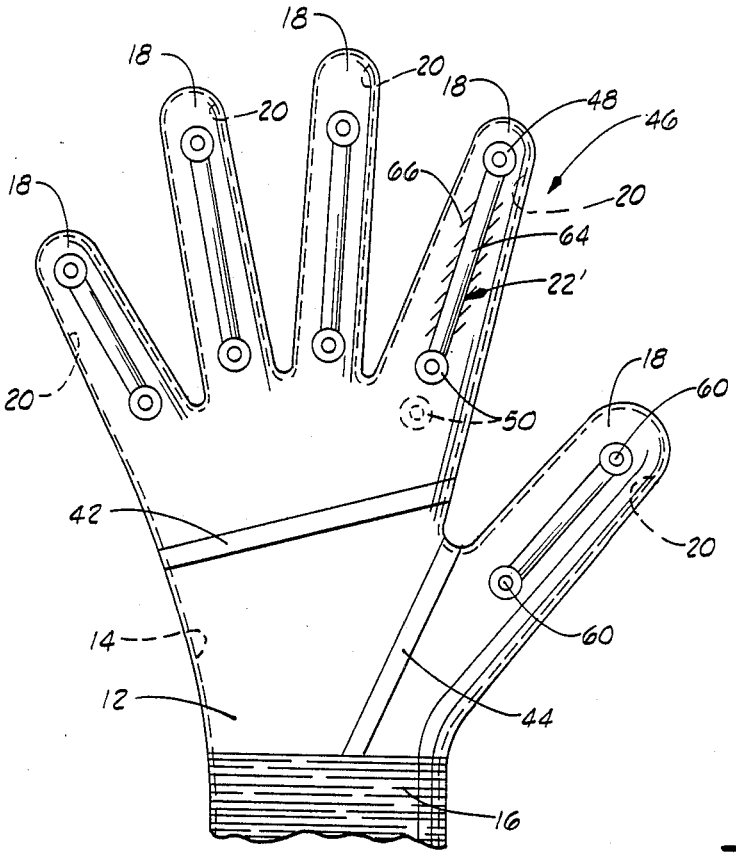
FIG. 5 illustrates a second embodiment of the invention as seen from the back of the hand of a user.

As shown in FIG. 5 and in a manner similar to the first embodiment, first connector 48 is positioned toward a distal end of finger portion 18, and second connector 50 is positioned either on finger portion 18 adjacent end portion 12, or alternatively on hand portion 12 itself as indicated by phantom lines for the index finger in FIG. 5.

Pin portion 54 of first connector 48 is directed generally toward second connector 50, and pin portion 54 of second connector 50 is generally directed toward first connector 48. Each pin portion 56 defines a plurality of flared sections 56 which taper inwardly away from base 52, as best shown in the cross section of FIG. 6.

Each base 52 defines a hole 58 therethrough which provides a means for attaching first and second connectors 48 and 50 to finger portions 18 by any fastening means, such as rivet 60 or sewing or the like.

Biasing means assembly 22' also comprises an elongated hollow tube 62 with opposite open ends adapted to be slidably received over pin portions 58 of the first and second connectors. Tube 62 is made of rubber or other elastomeric material and is sized such that it grips pin portions 54. It will be seen that by the configuration of flares 56, more resistance is provided for removing tube 62 from pin portions 54 than for installing the tube. Tube 62 has a length such that it must always be stretched between connectors 48 and 50. Thus, tube 62 is always in tension, and acts as a biasing means which applies a force tending to move connectors 48 and 50 closer together.

Also extending longitudinally between first and second connectors 48 and 50 is a sleeve 64 through which tube 62 is slidably disposed. Sleeve 64 is made of a flexible material such as cloth. In one preferred embodiment, sleeve 64 comprises a larger diameter elastomeric tube made of the same material as tube 62. Sleeve 64 is connected to finger portion 18 by sewing or other means, generally indicated by the numeral 66. Thus, a guide means is provided for tube 62 of biasing means assembly 22' so that the tube cannot skew when finger portion 18 is bent as shown in FIG. 8.

Figure 8:
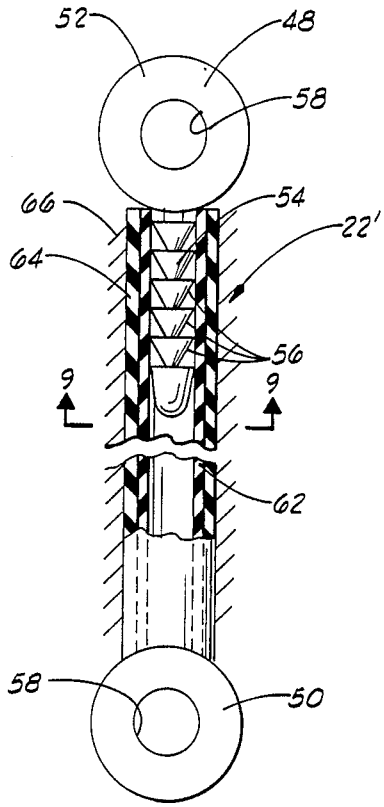
FIG. 8 shows a detail of a finger portion of the second embodiment with the finger of the user bent.
Figure 7:
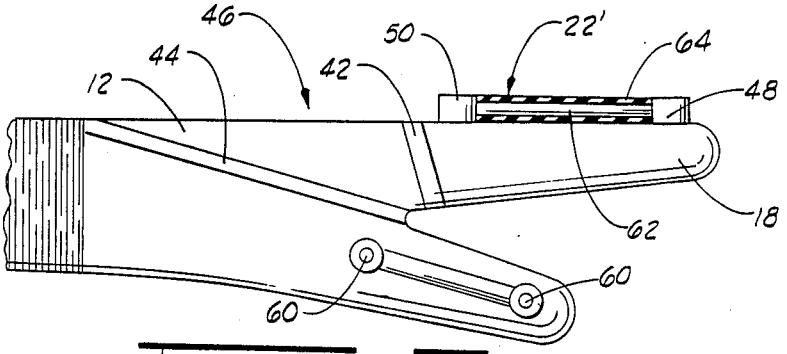
FIG. 7 is a side view of the second embodiment with the fingers extended.
Figure 6:
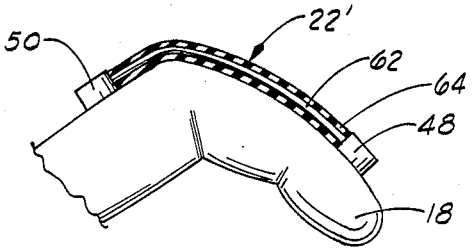
FIG. 6 is an enlarged view of the biasing means used in the second embodiment.
Figure 9:
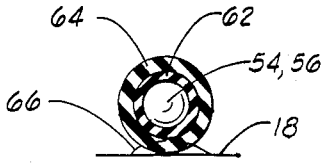
FIG. 9 is a cross-section along 9—9 in FIG. 6.

As with the first embodiment, it will be seen that when finger portions 18 are bent as shown in FIG. 8, with biasing means assembly 22' on the dorsal side, the tension in each tube 62 is increased to provide the force tending to return the fingers to the extended position shown in FIG. 7, at which the length of tube 62 is at a minimum. Thus, a method is also provided for the user to exercise and strengthen the fingers when using second embodiment 46 of the invention.

By properly sizing tube 62 and flared sections 56 of pin portions 54 of first and second connectors 48 and 50, the gripping engagement between tube 62 and pin portions 54 will be such that tubes 62 will not slide off the pin portions when finger portion is bent. However, by manually applying additional force on tube 62, tube 62 can still be moved longitudinally off pin portions 54 when desired to replace the tube.

Tubes 62 are thus easily attached to, and detached from, at both ends thereof from first and second connectors 48 and 50 for easy interchangeability with other tubes of different lengths to increase or decrease the tension applied to finger positions 18. One method of increasing the tension in tube 62 is to disconnect either end from the corresponding pin portion 54 of first or second connector 48 and 50 and then cut the length of tube 62 to shorten it. It will be seen that a new open end of tube is formed, and, when tube 62 is again replaced on pin portion 54, the amount of stretch of the tube between first and second connectors 48 and 50 is increased, thus increasing the tension applied on finger portion 18.

As with first embodiment 10, second embodiment 14 of the orthopedic exercise glove of the present invention may also include weighted bands 42 and 44 for providing additional resistance for the raising of the hand and bending the fingers thereof. Further, base 52 of first and second connectors 48 and 50 may be weighted as desired, although in the preferred embodiment, base 52 and pin portion 54 of first and second connectors 48 and 50 are integrally formed of an injection molded material such as plastic.

With either embodiment, it will be seen that spring 32 and elastomeric tube 62 provide a removably attachable biasing means which provides for quick and easy interchangeability of springs or tubes to vary the tension applied along finger portions 18.

An exercise glove is thereby provided for exercising and strengthening the fingers of the hand. Such exercise is important for patients having hand injuries, arthritis or other pathological problems with their hands or fingers. The invention is also well adapted for providing an exercise glove for improving the dexterity of the fingers, such as required by musicians playing stringed instruments, the piano, or the like. The glove may even be worn without difficulty while the musician practices the instrument, particularly when the biasing means is on the dorsal side of the fingers. When the glove is removed, finger speed is increased in a manner similar to the batting speed of a baseball batter who warms up with a weighted bat.

It can be seen, therefore, that the orthopedic exercise glove of the present invention is well adapted to carry out the ends and advantages mentioned, as well as those inherent therein. While two presently preferred embodiments of the invention have been provided for the purposes of this disclosure, numerous changes in the arrangement and construction of parts may be made by those skilled in the art. All such changes are encompassed within the scope and spirit of the appended claims.

What is claimed is:

1. An orthopedic glove comprising:

a body portion for enclosing a hand of a user;

a finger portion attached to said body portion for enclosing a finger of said hand;

biasing means disposed along said finger portion for providing a force along said finger portion; and releasable attaching means for releasably attaching said biasing means to said finger portion, said releasable attaching means comprising:

first connecting means attached to said finger portion for connecting to said biasing means and comprising:

a base portion attached to said finger portion; and an elongated portion extending from said base portion and having a plurality of flared sections thereon; and second connecting means spaced from said first connecting means and attached to at least one of a group comprising said finger and body portions for connecting to said biasing means such that said biasing means extends between said first and second connecting means, said second connecting means comprising:

a base portion attached to at least one of a group comprising said finger and body portions; and an elongated portion extending from said base portion of said second portion and having a plurality of flared sections thereon;

wherein, said biasing means comprises a resilient tube having opposite open ends disposed over said elongated portions such that said ends are grippingly engaged with said flared sections.

2. The glove of claim 1 wherein said tube has a length whereby said tube is always in tension when said ends thereof are grippingly engaged with said flared sections.

3. An exercise glove comprising:

a hand portion defining a hand receiving cavity therein;

a plurality of finger portions, each finger portion defining a finger receiving cavity therein in communication with said hand receiving cavity;

first connecting means for attaching to a distal end of each finger portion and comprising a base having a flared pin extending therefrom;

second connecting means for attaching to at least one of a group comprising said finger and hand portions and comprising a base having a flared pin extending therefrom; and biasing means having first and second ends, and extending along each of said finger portions, said first and second ends of each biasing means being releasably connected to corresponding first and second connecting means, respectively, said biasing means being tensioned for applying a force tending to shorten the distance between said corresponding first and second connecting means, and said biasing means being characterized by an elastomeric tube stretched between said first and second base and having opposite ends adapted for grippingly engaging said flared pins.

4. The glove of claim 3 wherein each of said bases comprises a substantially annular ring integrally formed with said flared pins.

5. The glove of claim 4 wherein said pins extend substantially perpendicular to a central axis of said ring.

6. The glove of claim 3 wherein said tube is interchangeable with tubes of different lengths.

7. The glove of claim 3 wherein said tube may be shortened for increasing the tension therein when stretched between said first and second bases.

8. An exercise glove comprising:

a hand portion defining a hand receiving cavity therein;

a plurality of finger portions, each finger portion defining a finger receiving cavity therein in communication with said hand receiving cavity;

a first connecting means attached to a back portion of a distal end of each finger portion;

a second connecting means attached to a back portion of each finger portion adjacent said body portion;

biasing means having first and second ends, each of said biasing means extending along a back portion of one of said finger portions, said first and second ends being releasably connected to corresponding first and second connecting means, respectively, said biasing means being tensioned for applying a force tending to shorten a distance between said corresponding first and second connecting means; and an elongated sleeve disposed around each of said biasing means.

9. The glove of claim 8 wherein each of said sleeve is attached to said back portion of said corresponding finger portions.

10. The glove of claim 9 wherein said sleeve is flexible.

11. The glove of claim 8 wherein:

said first connecting means comprises a base having a hook extending therefrom;

said second connecting means comprises a base having a hook extending therefrom; and said biasing means is characterized by a coiled tension spring having first and second ends adapted for releasably engaging said hooks.

12. The glove of claim 11 wherein at least one of said bases comprises a lead weight.

13. The glove of claim 11 wherein said tension spring is interchangeable with another tension spring having a different spring rate.

14. The glove of claim 8 wherein:

said first connecting means comprises a base having a flared pin extending therefrom;

said second connecting means comprises a base having a flared pin extending therefrom; and said biasing means is characterized by an elastomeric tube stretched between said first and second bases and having opposite ends adapted for grippingly engaging said flared pins.

15. The glove of claim 14 wherein each of said bases comprises a substantially annular ring.

16. The glove of claim 15 wherein said pins extend substantially perpendicular to a central axis of said ring.

17. The glove of claim 14 wherein said tube is interchangeable with a tube of different length for varying said force.

18. The tube of claim 14 wherein said tube may be shortened for increasing the tension therein when stretched between said first and second bases.

19. A method of applying a force along a finger portion of an exercise glove, said method comprising the steps of:

attaching a first connector having a flared pin portion thereon to said glove adjacent a distal end of said finger portion;

attaching a second connector having a flared pin portion thereon to said glove adjacent a hand portion of said glove;

positioning between said first and second connectors an elastomeric tube of a length shorter than a distance between said first and second connectors; and stretching said elastomeric tube and attaching said elastomeric tube to said first and said connectors by sliding opposite open ends of said elastomeric tube on each of said pin portions such that said elastomeric tube is grippingly engaged therewith.

20. The method of claim 19 further comprising the steps of:

disconnecting one of said ends of said elastomeric tube from the corresponding pin portion;

shortening the length of said elastomeric tube by cutting off a portion thereof and thereby forming a new open end; and stretching said elastomeric tube and reattaching said new open end to said corresponding pin portion thereby increasing said force.

* * * * *